US005704134A

United States Patent [19]

Carter et al.

[11] Patent Number: 5,704,134

[45] Date of Patent: Jan. 6, 1998

[54] TRIM BLOCK DRYING RACK AND METHOD

[75] Inventors: John L. Carter, Portland; Everett C. Davidson, Hillsboro; Larry C. Lagging, Milwaukie, all of Oreg.

[73] Assignee: Carter Sprague Inc., Beaverton, Oreg.

[21] Appl. No.: 543,490

[22] Filed: Oct. 16, 1995

[51] Int. Cl.[6] ..... F26B 7/00

[52] U.S. Cl. ..... 34/396; 34/442; 34/518; 34/94; 414/789.5; 211/59.4

[58] Field of Search ..... 34/306, 380, 381, 34/382, 396, 442, 518, 90, 94, 103, 107, 143, 211, 237, 238, 239; 211/60.1, 59.4; 144/254, 364, 380; 432/6; 414/8, 789.5; 53/447, 540; D6/411, 390, 499; 108/52.1

[56] References Cited

U.S. PATENT DOCUMENTS

| | | | |
|---|---|---|---|
| 295,418 | 3/1884 | Nichols | 34/237 |
| 1,976,410 | 10/1934 | Oakleaf | 34/518 X |
| 2,095,319 | 10/1937 | Drake | 34/518 |
| 4,106,215 | 8/1978 | Rosen | 34/380 X |
| 4,199,870 | 4/1980 | Arsenault | 34/518 X |
| 4,294,364 | 10/1981 | Bilbrey | 211/60 R |
| 4,788,777 | 12/1988 | Davis | 34/518 X |

*Primary Examiner*—John M. Sollecito
*Assistant Examiner*—Steve Gravini
*Attorney, Agent, or Firm*—Kolisch, Hartwell, Dickinson, McCormack & Heuser

[57] ABSTRACT

A rack assembly for drying short lumber pieces is provided. The rack assembly includes unitary racks for supporting each tier of lumber pieces in a stack. Each rack includes transverse stickers to separate it from the preceding tier and a number of longitudinal tracks to guide the placement of the short lumber pieces. The pieces are arranged end-to-end in rows extending the length of the rack and the rows are arranged side-by-side across the width of the rack. A method of using such a rack to facilitate the drying of lumber is also provided.

3 Claims, 3 Drawing Sheets

10
12
16
18
20
22
24
26
28
30
32
34
36
4
4

TRIM BLOCK DRYING RACK AND METHOD

FIELD OF THE INVENTION

This invention relates generally to the drying of lumber. More particularly, the invention is directed to a rack assembly and method of using the same to dry short trim blocks.

BACKGROUND Of THE INVENTION

When logs are first harvested, the wood contained therein has a relatively high moisture content of 40–60%. With time and exposure to the atmosphere, this "green" wood will tend to dry to an equilibrium moisture content of 6–15%. Since most logs are milled into dimensioned lumber while they are still green, the drying process normally is carried out on the milled boards rather than the raw logs.

As the logs are cut into dimensioned lumber, and particularly in the process of cutting the boards to length, large numbers of "scrap" trim ends are created. These trim ends are short, typically 4- to 24-inch, blocks of dimensioned lumber. In the past, these short pieces were often ground up into chips for particle board or other uses. Increasing restrictions on logging and associated increases in the cost of lumber provide an impetus to find alternative, more productive uses for the trim ends. One way the value of these scrap trimmings can be increased is by using them as stock for producing long boards by finger jointing.

The high moisture content of green wood is an impediment to using the trimmings as finger jointing stock because it is difficult to achieve adequate glue adhesion to green wood. Moreover, because wood shrinks as it dries, stresses can build up in the wood and lead to warpage, twisting and cracking during the drying process. Once the wood reaches its equilibrium moisture content, however, it becomes relatively stable. To minimize the amount of warpage or other deformation after assembly, it is desirable to use boards that are already dry as stock for finger jointing.

The various deleterious effects of drying can be minimized by carefully supporting the lumber during the drying process so that it is held flat and straight while it dries. Unfortunately, it takes a long time—roughly one year per inch of thickness—for green wood to reach moisture equilibrium with the atmosphere unless the process is facilitated in some way. Since most uses of lumber require that it be dry, kilns are used to accelerate the drying process. A kiln subjects wood to a constant circulation of hot dry air which rapidly extracts the excess moisture.

In order to provide adequate circulation for the air, wood in kilns is typically arranged in stacks in which each tier of boards is separated by thin slats of wood known as stickers. The stickers, which are placed approximately every two feet, serve the dual purpose of supporting the wood to prevent warpage or twisting and insuring adequate space for airflow between the layers.

With boards of uniform length, the process of arranging the boards on a stack with each layer separated by a set of stickers is relatively straight forward. The first tier of boards is arranged edge to edge on a pallet of some kind. Stickers are then laid across this first tier to support the second tier, which is laid on top of the stickers. Subsequent tiers are added until the desired stack size is reached.

Arranging and supporting boards for drying is considerably more difficult when the boards are short and of varying length. With long boards, the stickers can be placed every 24 inches for support. With boards as short as 4 to 6 inches, however, stickers can no longer be separated by such large distances. Rather, the stickers must be placed on centers as small as 4 inches so that each block is supported. Each sticker must be individually placed by a worker. Since the stickers simply rest on the top of the lower tier, they are easily disturbed by inadvertent bumping that may occur as subsequent stickers are added. In addition, the person creating the stack, which is typically 4×8 feet in size, must reach across the stack to place some boards, which can also result in misadjustment of the stickers.

It is important to place the stickers at the same locations in each tier of the stack so that the weight of upper tiers is transmitted directly down through the stickers. If the stickers are offset from one another in adjacent tiers, the weight of the upper tiers will create a large bending force in the boards between the offset stickers. Because the process of stacking short trim blocks for drying must be done by hand and is quite time consuming, it adds substantially to the cost of drying the blocks.

Thus, it is an object of the present invention to provide a method and rack for supporting short boards of varying length while they are being dried that does not entail the time consuming process of placing each board on closely spaced stickers.

It is another object of the present invention to provide a rack for use in the process of drying lumber that replaces individual stickers with a unitary structure.

It is also an object of the present invention to provide a unitary rack for use in drying short pieces of lumber that will facilitate their arrangement into rows with minimal effort.

One more object of the present invention is to provide a drying rack that allows uniform air flow to reach each piece of lumber and which prevents excessive moisture loss from the ends of short pieces.

Yet another object of the present invention is to provide a method of stacking short pieces of lumber in a stack so that the stack of short pieces can be dried with conventional or standard length lumber.

SUMMARY OF THE INVENTION

The present invention is a rack assembly for use in drying lumber. More particularly, the present invention is a rack assembly including unitary racks for supporting each tier of boards in a stack, where each rack includes transverse stickers to separate it from the preceding tier and a number of longitudinal tracks to guide the placement of a plurality of short blocks to be dried. The present invention also encompasses a method of using a rack as described above to facilitate the drying of lumber.

DETAILED DESCRIPTION

Figures 1, 2, 3, 4:
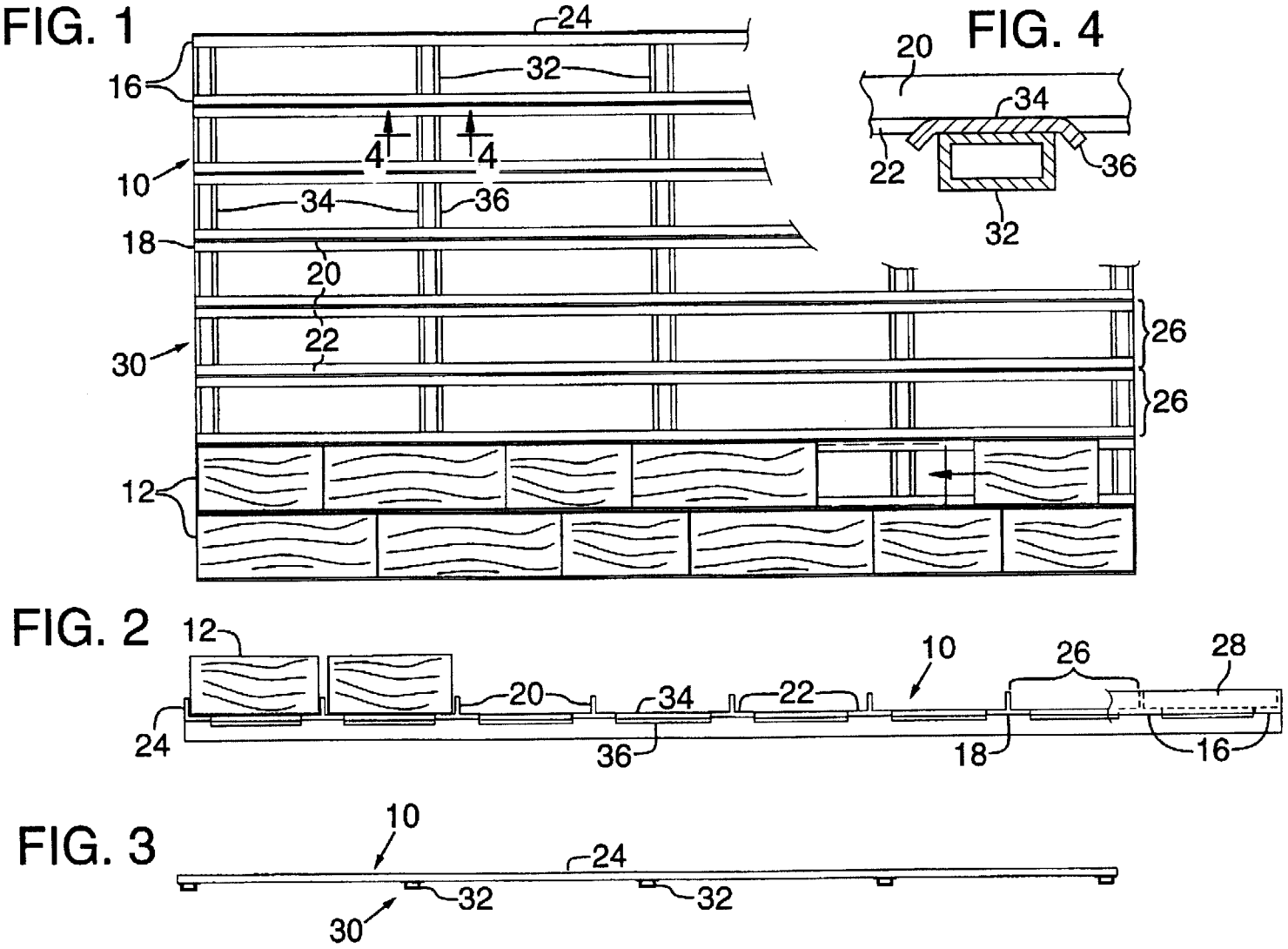
FIG. 1 is a plan view of a drying rack constructed according to the present invention.
FIG. 2 is an enlarged end view of the rack of FIG. 1.
FIG. 3 is a side view of the rack of FIG. 1.
FIG. 4 is a cross-sectional view of a sticker and support plate along line 4—4 of FIG. 1.

A rack according to the present invention is shown generally at 10 in FIG. 1. Rack 10 is designed to hold numerous short lumber pieces or blocks 12 in an end-to-end arrangement in rows with the rows being arranged side-by-side across the width of the rack. The number of rows per rack will depend on the width of the blocks. For 2×4 blocks, there will typically be 12 rows, whereas for 2×6 blocks there will only be 8 rows, as shown in FIG. 1. In the present embodiment, the rows are approximately 8 feet long.

The rows of blocks are established by a set of longitudinal rails 16 extending the length of rack 10. See FIG. 2. A T-shaped rail 18 extends between each two rows of blocks and includes a vertical flange 20 to separate the rows. Bottom flanges 22 extend into each row a short distance from either side of the vertical flange to support the blocks from the bottom. At each edge of the rack is an L-shaped rail 24 which includes vertical flange 20 and one bottom flange.

The vertical flanges and bottom flanges on adjacent guide rails form tracks 26 to guide the blocks as they are placed on rack 10. As blocks 12 are added to rack 10 they slide down tracks 26 until they contact the preceding block. See FIG. 1. The tracks cause the ends of the blocks to be automatically abutted, thus reducing moisture loss through the ends of the block, which otherwise can lead to cracking or other defects in the ends. An endcap 28 may be included at the end of tracks 26 to provide a stop to prevent the blocks from sliding past the end of the track as subsequent blocks are added.

A sticker structure 30 including a number of elongate transverse stickers 32 is welded to longitudinal rails 16 under bottom flanges 22. Stickers 32 are evenly spaced along the length of rack 10 at approximately two foot intervals and extend transversely across the rack. See FIGS. 1 and 3. In the present embodiment, stickers 32 are formed from aluminum tubing ¾ of an inch thick by 1½ inches wide. The ends of stickers 32 are left open to allow air to flow therethrough, thereby maximizing heat transmission through the rack. Heat transmission is further facilitated by forming the guide rails from aluminum. Use of aluminum in the structure of the rack has the additional benefit of providing a light-weight, rust free structure.

The arrangement of rails 16 on stickers 32 leaves gaps between the upper surface of the stickers and the lower surface of the blocks between the bottom flanges. As shown in FIG. 4, the gaps are filled by support plates 34 which have the same thickness as the bottom flanges and extend therebetween. Support plates 34 include down turned ends 36 which extend slightly past the edges of stickers 32 to provide a deflection lip for the blocks. Down turned ends 36 prevent blocks 12 from becoming caught on the edge of the support plates as they slide down tracks 26.

Figure 8:
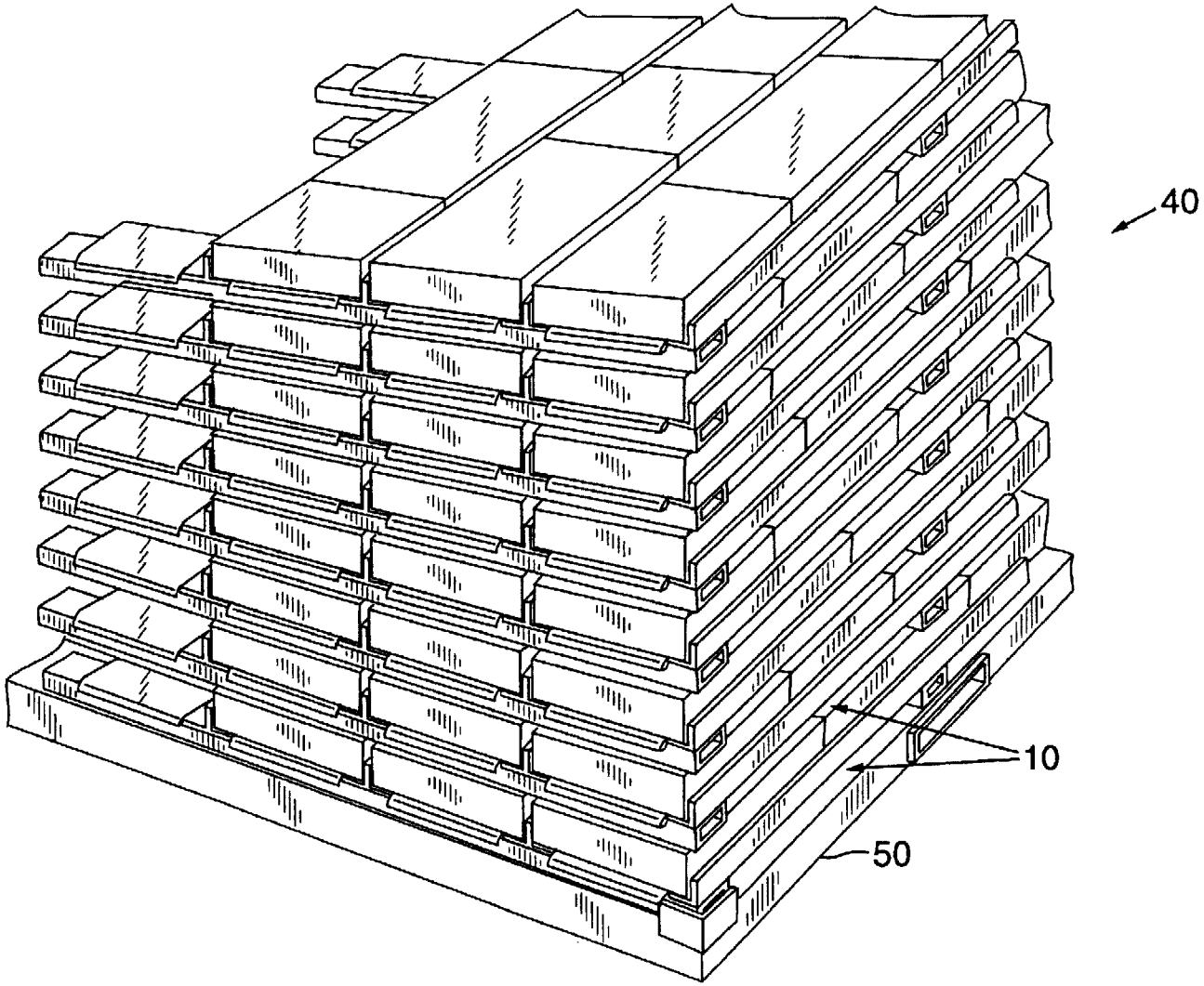
FIG. 8 is a perspective view of a tiered stack of lumber pieces according to the present invention.

Rack 10 is designed for incorporation into a rack assembly or stack 40 of similar racks as shown in FIG. 8. When placed in stack 40, the stick of racks 10, which rest on the top of the blocks in the previous tier, provide spacing between the tiers of the stacks. This allows air circulation throughout the stack to facilitate the drying process. Also, because no additional, air-flow impeding stickers are needed in sections of the stack with shorter blocks, air-flow, and therefore drying, is more consistent than in stacks using multiple stickers to support short block and fewer stickers to support longer blocks. As an additional benefit, stack 40 is of standard size and configuration and can therefore be dried in a kiln along side conventionally stacked lumber.

The fact that all the stickers for a tier are placed at one time with the proper spacing already established is one of the principle benefits of the present invention. This eliminates the need for large numbers of separate stickers that would have to be individually placed. Furthermore, because the stickers need only be incorporated at 24 inch intervals, rather than intervals as small as 4 inches, as would normally be required for short blocks, substantially more surface area of the blocks is exposed to the drying air flow. Pre-spaced stickers also make it easier to insure that the stickers in each succeeding tier are placed directly over the stickers in the preceding tier to prevent creation of bending loads on the blocks.

When the racks are loaded and arranged in stack 40, support plates 34 and stickers 32 help to spread the weight from the upper tiers over a larger surface area of the blocks to prevent the deformation that otherwise might occur. As a sticker from an upper tier pushes down on a block in the next lower tier, the force is transmitted not just through the portions of the block in contact with the bottom flange over the lower sticker, but through the support plate as well. Without the support plate, the center portion of the block would not be supported and would therefore tend to sag because of the applied load.

Figure 6:
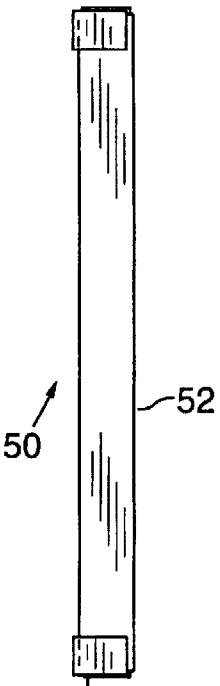
FIG. 6 is an end view of the pallet of FIG. 5.
Figure 9:
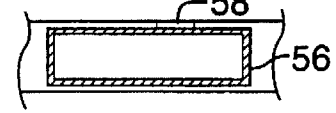
FIG. 9 is a cross-sectional view of a fork tube in the pallet of FIG. 5.
Figure 5:
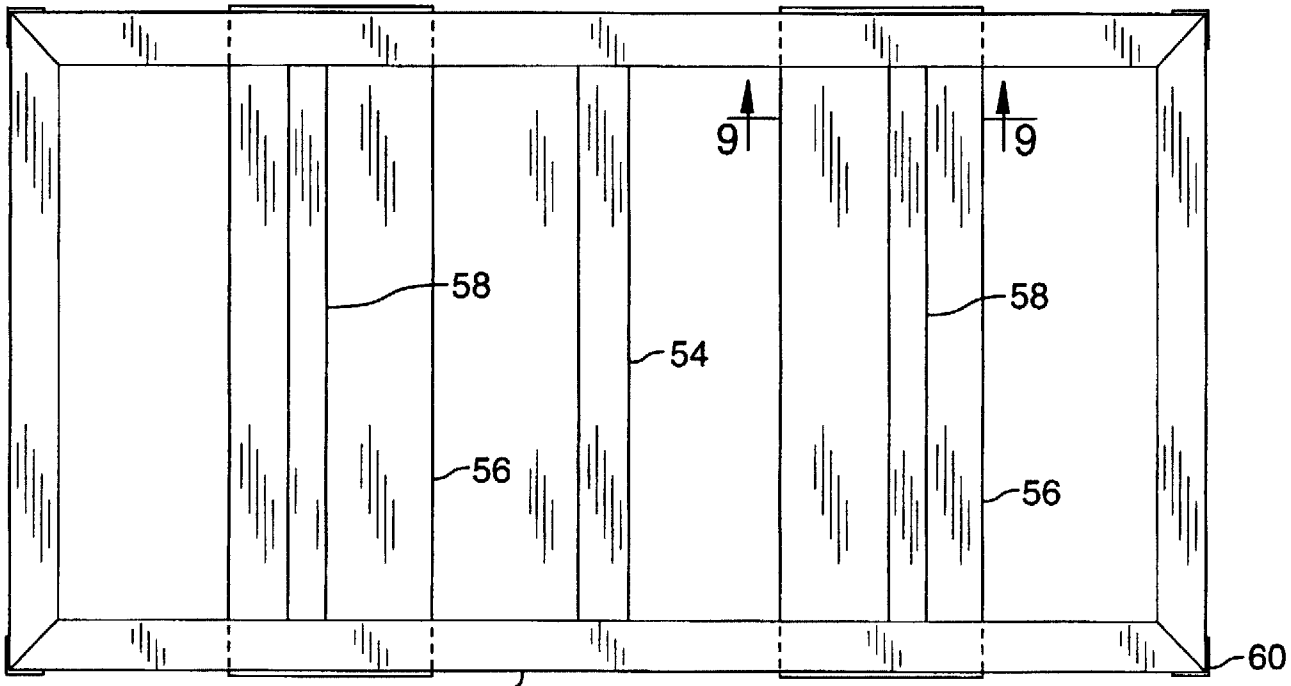
FIG. 5 is a plan view of a pallet for use with the rack of FIG. 1.
Figure 7:
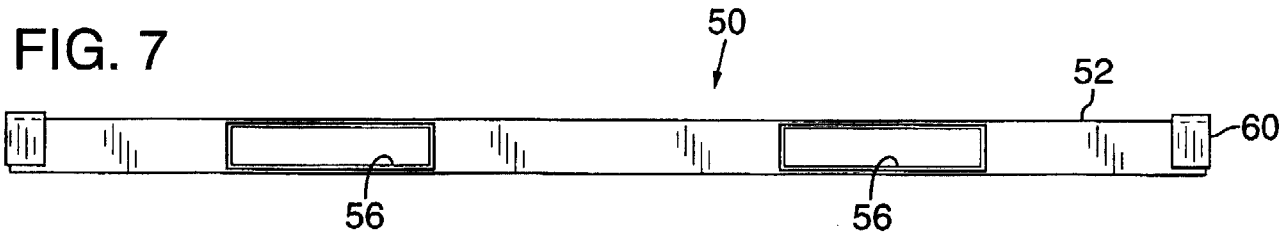
FIG. 7 is a side view of the pallet of FIG. 5.

Stack 40 is supported on the bottom by a pallet 50 which is shown in FIGS. 5–7. Pallet 50 includes a tubular frame 52 which extends around its perimeter. Frame 52 also includes a center tube 54 which extends across the pallet between opposite sides. Center tube 54 provides a supporting surface for the center sticker of the lowest rack. A pair of fork tubes 56 extend transversely between opposite sides of the tubular frame to allow use of a forklift to pick up the pallet. A shim plate 58 extends along the top of each fork tube between the sides of the tubular frame to provide a flat surface for the stickers from the lowest rack. See FIG. 9. A comer guide 60 is disposed at each corner to insure that the first rack is properly positioned on the pallet.

Assembly of stack 40 starts with the placement of an empty rack on pallet 50. Blocks 12 are then added to rack 10 by sliding them down tracks 26 between the vertical flanges until the abut the previous block or fill a row. See FIG. 1. Blocks are added until the rack is filled, and then another empty rack is placed on top of the just filled rack. This process is repeated until the desired number of tiers are completed.

The provision of rails 16 with bottom flanges 22 eliminates the need to provide stickers under every block. Without rack 10, it would be necessary to place stickers at very short intervals to insure that every block was supported. This process requires a large number of stickers and is very time consuming and therefore expensive to carry out. With tracks 26, on the other hand, the loader can quickly slide the blocks into position without worrying about placing stickers for support. This dramatically speeds the process of creating a stack of blocks for drying.

In addition, by virtue of being able to slide the blocks down the tracks, the loader can stand at one end and completely fill the entire rack without moving from that location. Unloading the racks of the present invention after drying is also considerably easier than would be the case with stacks incorporating individual stickers. A push stick can be used to push off all of the blocks on an entire tier at once. The empty rack is then lifted off and the process is repeated with the next tier. With a traditionally constructed stack, the blocks and stickers must be removed one-by-one.

Because of the dramatic reduction in labor costs associated with use of the present invention, the cost effectiveness of drying short blocks for use as stock for finger jointing is greatly increased. Moreover, use of the rack of the present invention reduces damage to the blocks during loading, unloading and drying.

It will now be clear that an improvement in this art has been provided which accomplishes the objectives heretofore set forth. While the invention has been disclosed in its preferred form, it is to be understood that the specific embodiment thereof as disclosed and illustrated herein is not to be considered in a limited sense as there may be other forms or modifications which should also be construed to come within the scope of the appended claims.

We claim:

1. A method of stacking short lumber pieces for drying, the method comprising:

preparing a first tier of short lumber pieces, where the lumber pieces are shorter than the tier and arranged end-to-end in rows extending the length of the tier with the rows arranged side-by-side across the width of the tier;

placing a unified rack on top of the first tier of lumber pieces with the rack having sufficient length to support multiple pieces disposed end-to-end, the rack including track structure extending the length thereof to guide the placement of short lumber pieces with the pieces shifted lengthwise therealong, and the rack further having sticker structure joined to the track structure to support the track structure and lumber pieces placed thereon in spaced relation from the first tier of lumber pieces;

filling the track structure with lumber pieces to prepare a second tier; and repeating the steps of placing and filling to prepare an overlying third tier.

2. The method of stacking short lumber pieces of claim 1, wherein the first tier is prepared on a unified rack including track structure to guide the placement of short lumber pieces and sticker structure joined to the track structure to support the track structure, the method further including the step of providing a pallet adapted to be picked up by a forklift with the pallet in supporting relation under the first tier.

3. The method of claim 1, wherein the step of filling the track structure with lumber pieces includes the steps of positioning a first lumber piece on the track structure and sliding that first piece to one end of the track structure.

* * * * *